US006158963A

United States Patent [19]

Hollis et al.

[11] Patent Number: 6,158,963

[45] Date of Patent: Dec. 12, 2000

[54] COATED ARTICLE AND METHOD FOR INHIBITING FRICTIONAL WEAR BETWEEN MATING TITANIUM ALLOY SUBSTRATES IN A GAS TURBINE ENGINE

[75] Inventors: Terry L. Hollis, Lantana; Thomas J. Rising, Palm City; John G. Dorrance, Jupiter; Bruce I. Beeman, Jr., West Palm Beach, all of Fla.

[73] Assignee: United Technologies Corporation, Hartford, Conn.

[21] Appl. No.: 09/430,974

[22] Filed: Nov. 1, 1999

Related U.S. Application Data

[62] Division of application No. 09/031,498, Feb. 26, 1998.

[51] Int. Cl.[7] ..... F01D 5/30

[52] U.S. Cl. ..... 416/219 R; 427/456

[58] Field of Search ..... 416/219 R; 427/456

[56] References Cited

U.S. PATENT DOCUMENTS

| | | | |
|---|---|---|---|
| 4,023,252 | 5/1977 | Levinstein et al. | 427/456 X |
| 4,196,237 | 4/1980 | Patel et al. | 428/591 |
| 4,215,181 | 7/1980 | Betts | 428/591 |
| 5,161,898 | 11/1992 | Drake | 384/95 |
| 5,240,375 | 8/1993 | Wayte | 416/219 R |
| 5,296,057 | 3/1994 | Baba et al. | 148/436 |
| 5,441,554 | 8/1995 | Romero et al. | 75/255 |
| 5,601,933 | 2/1997 | Hajmrle et al. | 416/219 R |

OTHER PUBLICATIONS

Metals Handbook American Society for Metals, 1939, Cleveland, Ohio, pp. 1408–1410, 1425–1427.

*Primary Examiner*—John E. Ryznic
*Attorney, Agent, or Firm*—Richard D. Getz

[57] ABSTRACT

A pair of mating titanium alloy substrates for use in a gas turbine engine are provided, one of which comprises an aluminum bronze alloy wear resistant coating. The coating consists essentially of 9.0–11.0% aluminum (Al), 0.0–1.50% iron (Fe), and a remainder of copper (Cu). The wear resistant coating is disposed between the mating substrates and inhibits frictional wear between the mating substrates.

9 Claims, 1 Drawing Sheet

COATED ARTICLE AND METHOD FOR INHIBITING FRICTIONAL WEAR BETWEEN MATING TITANIUM ALLOY SUBSTRATES IN A GAS TURBINE ENGINE

This is a division of copending application Ser. No. 09/031,498, filed on Feb. 26, 1998.

The invention was made under a U.S. Government contract and the Government has rights herein.

BACKGROUND OF THE INVENTION

1. Technical Field

This invention relates to gas turbine engine rotor assemblies in general, and to apparatus for inhibiting fictional wear between mating titanium alloy substrates such as a rotor blade root and rotor disk slot, in particular.

2. Background Information

A conventional rotor stage of a gas turbine engine includes a disk and a plurality of rotor blades. The disk includes an inner hub, an outer hub and a web extending between the two hubs. The outer hub includes a plurality of blade attachment slots uniformly spaced around the circumference of the outer hub. Each rotor blade includes an airfoil and a blade root. The blade root of each blade is received within one of the blade attachment slots disposed within the disk. A variety of attachment slot/blade root mating pair geometries (e.g., dovetail, fir-tree) can be used.

Gas turbine rotor stages rotate at high velocities through high temperature gas traveling axially through the engine. The high temperature, high velocity environment places a great deal of stress on each blade root/attachment slot pair. For example, centrifugal force acting on each blade will cause the blade root to travel radially within the attachment slot as a load is applied and removed. In a similar manner, vibratory loadings can cause relative movement between blade root and attachment slot. In both cases, the relative motion between blade root and attachment slot is resisted by the mating geometry and by friction. The friction, in turn, causes undesirable frictional wear unless appropriate measures are taken.

The undesirable frictional wear referred to above predominantly consists of a "galling" process and/or a "fretting" process. Metals used in the manufacture of gas turbine rotor assemblies such as titanium, nickel, and others form a surface oxide layer almost immediately upon exposure to air. The oxide layer inhibits bonding between like or similar metals that are otherwise inclined to bond when placed in contact with one another. Galling occurs when two pieces of metal, for example a titanium alloy blade root and a titanium alloy blade attachment slot, frictionally contact one another and locally disrupt the surface oxide layer. In the brief moment between the disruption of the surface oxide layer and the formation of a new surface oxide layer on the exposed substrate, metal from one substrate can transfer to the other substrate and be welded thereto. The surface topography consequently changes further aggravating the undesirable frictional wear. Fretting occurs when the frictional contact between the two substrates disrupts the surface oxide layer and the exposed metal begins to corrode rather than exchange metal as is the case with galling.

In some applications, galling can be substantially avoided by positioning a dissimilar, softer metal between the two wear surfaces. The softer metal, and oxides formed thereon, provide a lubricious member between the two wear surfaces. Simply inserting a softer metal between the wear surfaces does not, however, provide a solution for every application.

On the contrary, the lubricious member must be tolerant of the application environment. In the high temperature, high load environment of a gas turbine engine rotor, the choice of a lubricious medium is of paramount importance. The lubricious member must: 1) minimize galling and fretting between titanium and titanium alloys substrates; 2) tolerate high temperatures; and 3) accommodate high loads.

U.S. Pat. No. 4,196,237 issued to Patel et al. (hereinafter referred to as Patel) reports that a disadvantage of an aluminum bronze (Al-Bronze) coating as an anti-gallant is that such a coating has a relatively low hardness. Patel further reports that a spray powder alloy which includes minor percentages of Ni, Fe, Al, and a majority percentage of Cu avoids the complained of hardness problem. In fact, Patel reports test results which include an evaluation of a 88% Cu-10% Al-2% Fe alloy sprayed onto a 1020 steel substrate (a metal not well suited for gas turbine rotor applications), as well as other similar alloys which include up to 10% Ni sprayed on the same steel substrate. Patel indicates that the sprayed alloys containing Ni showed a "marked improvement" in hardness and wear resistance relative to the alloy without the Ni when applied to a 1020 steel substrate.

U.S. Pat. No. 4,215,181 issued to Betts (hereinafter referred to as Betts) discloses a method for inhibiting the effects of fretting fatigue in a pair of opposed titanium alloy mating surfaces. Betts indicates that copper shims provide beneficial protection from fretting when placed between the two opposed titanium alloy mating surfaces. Betts further indicates that a shim comprising an Al-Si-Bronze alloy did not prevent fretting fatigue of the substrates. In fact, Betts reports that the fatigue life of the specimen was essentially the same as that for the bare titanium fretting fatigue. A disadvantage of using a shim is that the shim, or a portion thereof, can dislodge and cause the then unprotected wear surfaces to contact one another. In a gas turbine engine application, a dislodged shim (or portion thereof) can also cause undesirable foreign object damage downstream.

Al-Bronze alloy anti-gallant coatings have been applied to nickel alloy stator vane rails and feet to prevent galling between the stator vanes and iron alloy outer casings. The load stresses in the stator vane applications are of a different nature than those between a rotor blade root and a rotor disk slot. Specifically, the centrifugal loading on the rotor blade creates a much higher load, and are much more localized, than that between the stator vane and the outer casing. The rotor blade is also subject to a high cycle motion, and consequent high cycle friction.

What is needed, therefore, is a method and apparatus for inhibiting the effects of frictional wear in a rotor blade root/attachment slot pair, one capable of performing in a gas turbine engine environment, one that can be used with titanium alloy substrates, one that minimizes the opportunity for foreign object damage with in a gas turbine engine, and one that is cost-effective.

DISCLOSURE OF THE INVENTION

It is, therefore, an object of the present invention to provide a method and apparatus for inhibiting the effects of frictional wear between mating titanium alloy substrates.

It is another object of the present invention to provide a method and an apparatus for inhibiting the effects of frictional wear between mating titanium alloy substrates tolerant of a gas turbine engine environment.

It is another object of the present invention to provide a method and an apparatus for inhibiting the effects of frictional wear between mating titanium alloy substrates which minimize the opportunity for foreign object damage within a gas turbine engine.

It is another object of the present invention to provide a method and an apparatus for inhibiting the effects of fictional wear between mating titanium alloy substrates which is cost-effective.

According to the present invention a pair of mating titanium alloy substrates for use in a gas turbine engine are provided, one of which has an aluminum bronze alloy wear resistant coating. The coating consists essentially of 9–11% aluminum (Al), up to 1.5% iron (Fe), and a remainder of copper (Cu). The wear resistant coating is disposed between the mating substrates and inhibits frictional wear between the mating substrates.

According to one aspect of the present invention, a method for minimizing frictional wear between the pair of mating titanium alloy substrates is provided which comprises the steps of: 1) providing an aluminum bronze alloy powder consisting essentially of 9–11% Al, up to 1.5% Fe, and a remainder of Cu; and 2) applying the aluminum bronze alloy to one of the titanium alloy substrates to form a coating on the substrate.

An advantage of the present invention to provide is that a method and an apparatus for inhibiting the effects of frictional wear between a pair of mating titanium alloy substrates is provided. Titanium alloy substrates are one of a small number of alloys that can accommodate a gas turbine engine environment. A coating, such as that disclosed in the present invention, provides great utility by increasing the durability of titanium alloys in a gas turbine environment.

Another advantage of the present invention is that the effects of frictional wear between a pair of mating titanium alloy substrates are inhibited with minimal opportunity for foreign object damage. The present invention provides means for inhibiting wear between mating titanium alloy substrates without the use of shims which can dislodge and potentially create foreign object damage downstream within a gas turbine engine.

Another advantage of the present invention is that a coating is provided that can protect a titanium rotor blade root/attachment slot pair from galling. Centrifugal force acting on the rotor blade places a significant load on the rotor disk, and the rotor blade root is subject to high cycle motion relative to the rotor disk. Frictional energy dissipated by the high load, high cycle motion causes unacceptable deterioration in most anti-gallant coatings. The present invention coating provides an effective anti-gallant for rotor blade root/attachment slot applications within a gas turbine engine that withstands high load, high cycle motion applications.

These and other objects, features and advantages of the present invention will become apparent in light of the detailed description of the best mode embodiment thereof, as illustrated in the accompanying drawings.

BEST MODE FOR CARRYING OUT THE INVENTION

Figure 1:
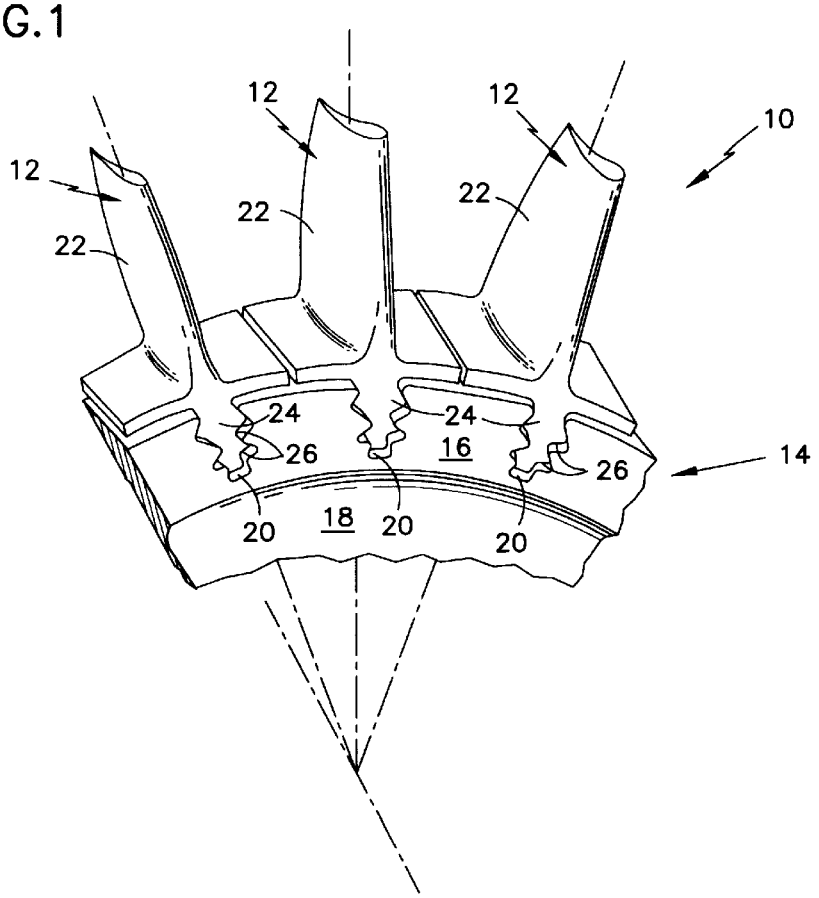
FIG. 1 is a diagrammatic partial view of a gas turbine engine rotor stage which includes a disk and a plurality of rotor blades conventionally attached to the disk.

In a gas turbine engine, each rotor stage 10 includes a plurality of rotor blades 12 and a rotor disk 14. The rotor disk 14 includes an outer hub 16, an inner hub (not shown), and a web 18 extending between the two hubs. A plurality of rotor blade attachment slots 20 are disposed in the outer hub 16, spaced around the circumference of the disk 14. Each rotor blade 12 includes an airfoil 22 and a blade root 24. The blade root 24 of each blade 12 is received within one of the blade attachment slots 20 disposed within the disk 14.

To minimize frictional wear, including galling and fretting, a lubricious wear resistant coating 26 is applied to one of the blade root 24 or blade attachment slot 20, in a position such that the coating 26 is disposed between the blade root 24 and attachment slot when the blade root 24 is received within the attachment slot 20. For ease of application, the wear resistant coating 26 is preferably applied to the blade root 24. The coating is formed from an Al-Bronze alloy powder comprising 9.0–11.0% Al, 0.0–1.50% Fe, balance Cu. The powder may, however, include up to 5% residual materials; i.e., materials which do not materially change the frictional properties of the coating. In the most preferred form, the powder consists essentially of 10% Al and 90% Cu.

The process of applying the coating begins by preparing the substrate surface (e.g., the blade root surface) to be coated. The first step is to remove debris and oxides from the substrate. Well known cleaning techniques such as degreasing, grit blasting, chemical cleaning, and/or electrochemical polishing can be used. For example, a degreasing solution followed by a grit blast procedure using #60 aluminum oxide grit applied with 35–45 p.s.i. pressure is adequate. Using the described grit blast technique also provides a desirable surface finish.

The coating may be applied by a variety of processes including, but not limited to, plasma spray, physical vapor deposition, HVOF, and D-Gun. Of the processes tested, plasma spraying appeared to produce the most favorable results. The powder particulate size applied during the testing was in the range of 270–325 microns. The preferred particulatesize will, however, vary depending on the application at hand (especially the surface finish of the mating substrate) and the desired coating roughness and microscopic properties of the application at hand. The powder was applied using a Plasmadyne™ plasma spray gun using argon as a primary gas and helium as a secondary gas. Application parameters such as primary and secondary gas flow rates, powder feed rate, will vary depending on the exact coating composition, the substrate composition, the application equipment, and the application environment. During testing the following application parameters were used:

Gas Volumetric Flow Rate: 100–125 scfh

Secondary Gas Volumetric Flow Rate: 25–40 scfh

Plasma Gun Voltage: 35–50 volts DC

Plasma Gun Amperage: 690–710 amps

Powder Feed Rate: 25–35 grams/min

The best test results were achieved when the coating was applied to a thickness between 0.0010–0.004 inches. A coating thickness outside the aforementioned range may, however, be advantageous for some applications.

Figure 2:
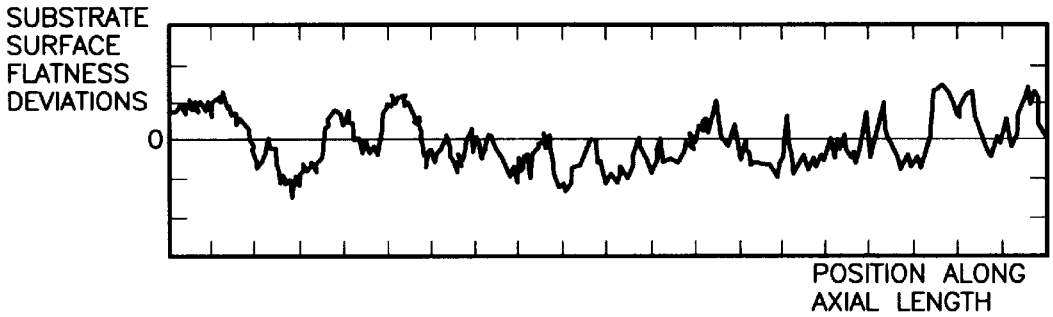
FIG. 2 is a graph which shows surface topography data generated in a test rig simulating a rotor blade root with a Cu-Ni anti-gallant coating interacting with a titanium test rig surface simulating a rotor blade attachment slot disposed in a rotor disk.
Figure 3:
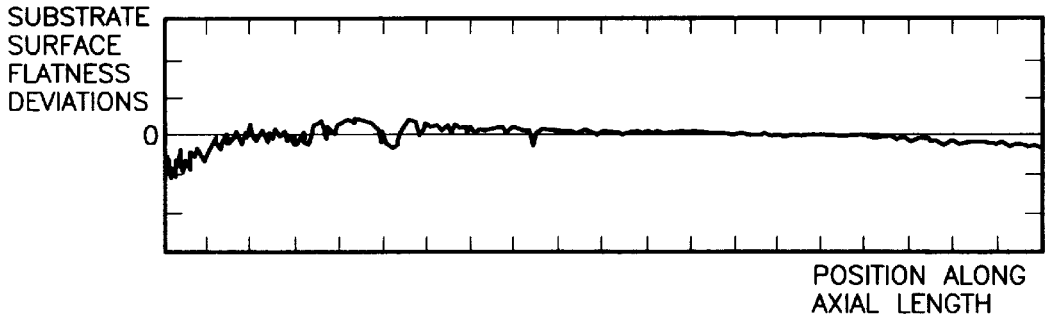
FIG. 3 is a graph which shows surface topography data generated in a test rig simulating a rotor blade root with a Al-Bronze anti-gallant coating interacting with a titanium test rig surface simulating a rotor blade attachment slot disposed in a rotor disk.

The graph shown in FIG. 2 shows surface topography data (substrate surface flatness vs. substrate axial length) generated in a test rig simulating a rotor blade root with a Cu-Ni anti-gallant coating interacting with a titanium test rig surface simulating an attachment slot disposed in a rotor disk. The graph shown in FIG. 3 shows a surface topography data (substrate surface flatness vs. substrate axial length) generated in a test rig simulating a rotor blade root with a Al-Bronze anti-gallant coating interacting with a titanium test rig surface simulating an attachment slot disposed in a rotor disk. The two tests were run under substantially the same test conditions. The surface graph depicting the Al-Bronze test data (FIG. 3) illustrates significantly fewer surface flatness deviations occurred using the Al-Bronze coating than the Cu-Ni coating (depicted in FIG. 2), thereby evidencing a much lower amount of undesirable frictional wear.

Although this invention has been shown and described with respect to the detailed embodiments thereof, it will be understood by those skilled in the art that various changes in form and detail thereof may be made without departing from the spirit and the scope of the invention.

We claim:

1. A pair of mating titanium alloy substrates for use in a gas turbine engine, comprising:

one of said mating titanium alloy substrates having an aluminum bronze alloy wear resistant coating, said coating consisting essentially of 9.0–11.0% Al, 0.0–1.50% Fe, and a remainder of Cu;

wherein said wear resistant coating is disposed between said mating substrates and inhibits frictional wear between said mating substrates.

2. A pair of mating titanium alloy substrates according to claim 1, wherein said aluminum bronze alloy coating comprises approximately 10.0% Al and a remainder of Cu.

3. A pair of mating titanium alloy substrates according to claim 2, wherein said aluminum bronze alloy coating is applied by a plasma spray process.

4. A pair of mating titanium alloy substrates according to claim 3, wherein said aluminum bronze alloy coating has a thickness of between 0.0010 and 0.0040 inches.

5. A pair of mating titanium substrates according to claim 4, wherein said mating substrates are a rotor blade root and a blade attachment slot disposed in a disk.

6. A method for minimizing frictional wear between a pair of mating titanium alloy substrates, comprising the steps of:

providing an aluminum bronze alloy powder consisting essentially of 9.0–11.0% Al, 0.0–1.50% Fe, and a remainder of Cu; and applying said aluminum bronze alloy powder to one of said titanium alloy substrates, thereby forming a coating on said one substrate.

7. A method according to claim 6, wherein said aluminum bronze alloy powder comprises approximately 10.0% Al and a remainder of Cu.

8. A method according to claim 7, wherein said aluminum bronze alloy powder is applied by a plasma spray process.

9. A method according to claim 8, wherein said aluminum bronze alloy powder is applied until said coating has a thickness of between 0.0010 and 0.0040 inches.

* * * * *